US009814960B1

(12) United States Patent
Bertini

(10) Patent No.: US 9,814,960 B1
(45) Date of Patent: Nov. 14, 2017

(54) GOLF TRAINING AID

(71) Applicant: Marco Bertini, San Marcos, CA (US)

(72) Inventor: Marco Bertini, San Marcos, CA (US)

( * ) Notice: Subject to any disclaimer, the term of this patent is extended or adjusted under 35 U.S.C. 154(b) by 0 days.

(21) Appl. No.: 15/429,936

(22) Filed: Feb. 10, 2017

(51) Int. Cl.
*A63B 69/36* (2006.01)

(52) U.S. Cl.
CPC ..... *A63B 69/3685* (2013.01); *A63B 69/3608* (2013.01); *A63B 2208/0204* (2013.01)

(58) Field of Classification Search
USPC ..... 473/212–214, 227, 276
See application file for complete search history.

(56) References Cited

U.S. PATENT DOCUMENTS

| | | | | |
|---|---|---|---|---|
| 5,259,621 | A * | 11/1993 | Keefer | A63B 69/0059 473/212 |
| 5,904,624 | A * | 5/1999 | Martinez | A63B 69/0059 273/DIG. 30 |
| 7,033,284 | B2 * | 4/2006 | Yoshimura | A63B 69/3608 473/212 |
| 7,455,595 | B1 * | 11/2008 | Gibbons | A63B 69/3608 473/212 |
| 2003/0148814 | A1 * | 8/2003 | Kim | A63B 69/0059 473/227 |

* cited by examiner

*Primary Examiner* — Nini Legesse
(74) *Attorney, Agent, or Firm* — Michael D. Eisenberg

(57) ABSTRACT

A golf training aid comprises a bottom piece with a slot. A vertical member attaches from the bottom piece to an upper member. A mechanism has sliders configured to slide up and down the mechanism, wherein the mechanism is attached to the upper member. An arm cuff is attached to each slider, configured to receive human arms. The upper member has a connector that attaches to a top end of a golf club and the golf club slides into the slot of the bottom piece.

8 Claims, 4 Drawing Sheets

GOLF TRAINING AID

FIELD OF THE INVENTION

The present invention relates to a golf training aid for practicing proper golf swing and putting techniques.

BACKGROUND OF THE INVENTION

One of the central aims in golfing is to hit a solid and straight shot. Successfully hitting a solid and straight shot depends on the golfer's swing. A more compact swing requires less hand and wrist movement so the golfer has increased shoulder mobility and rotation. Learning how to effectively swing requires a lot of time and patience. The current learning methods available include continuous practice with a golf club, videos that attempt to teach golfers how to put, and a swing path electronic device. All of these methods are helpful but there still exists a need for a more efficient practice method; a method that will physically aid a golfer in understanding and experiencing how each part of their body should move in order to contribute to the efficiency of their swing.

BRIEF SUMMARY OF THE EMBODIMENTS OF THE INVENTION

Figure 1:
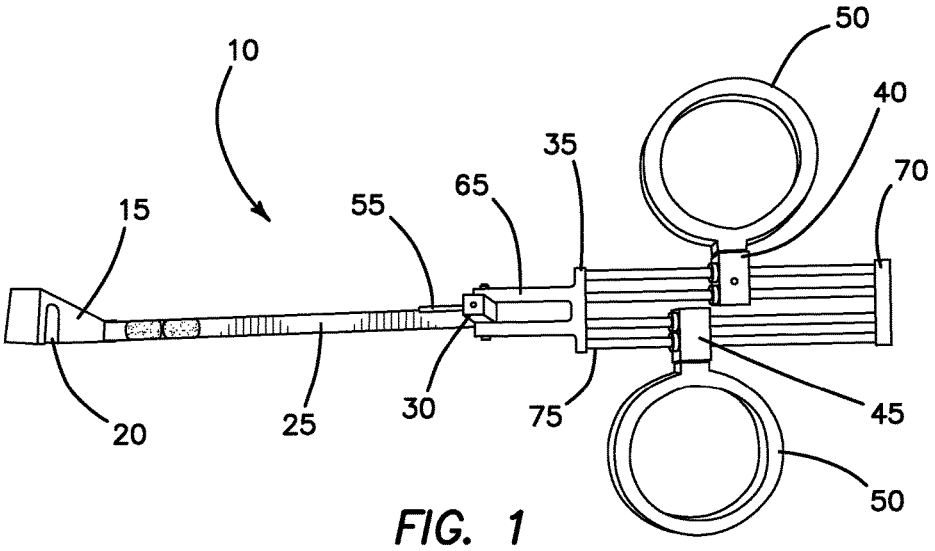
FIG. 1 is a top view of the golf training aid.

In a variant, a golf training aid comprises a bottom piece with a slot configured to receive a golf club. A vertical member attaches from the bottom piece to an upper member. A mechanism has sliders configured to slide up and down the mechanism, wherein the mechanism is attached to the upper member. An arm cuff is attached to each slider, configured to receive human arms. The upper member has a connector that attaches to a top end of the golf club.

In another variant, the upper member is connected to the mechanism via two support members extending from the mechanism, one on each side of the upper member.

In a further variant, the arm cuffs are rotatable and slidable with each swing of the golf club; wherein a golfer connects a golf club to the golf training aid and completes a full golf swing.

In another variant, the training aid has a first slider and a second slider which move independent of each other.

In still another variant, the first slider is configured to slide to the bottom of the mechanism and the second slider is configured to slide to the top of the mechanism when a user swings a golf club attached to the training aid.

In yet another variant, the support members allow the mechanism to fold down and over the vertical member into a closed position.

In another variant, the connector is a needle configured to penetrate into a channel in a top of a golf club.

In a further variant, each arm cuff moves with the respective slider to which it is attached.

In another variant, the mechanism comprises rails that have the sliders attached thereto, wherein the sliders are slidable along the rails.

In yet another variant, the golf training aid comprises a bottom piece having a slot, configured to receive the shaft of a golf club. A vertical member attaches from the bottom piece to an upper member. A mechanism has arm cuffs attached to each side of the mechanism, configured to receive human arms. The upper member has a connector that attaches to a top end of the golf club.

DETAILED DESCRIPTION OF THE EMBODIMENTS OF THE INVENTION

Throughout this document, the following reference numbers are used:

10 Golf training aid
15 Bottom piece
20 Slot
25 Vertical member
30 Upper member
35 Mechanism
33 Rails
40 First slider
45 Second slider
50 Arm cuff
55 Needle
60 Golf club
65 Support member
70 Top of mechanism
75 Bottom of mechanism
80 Top end of golf club
85 Human arms In a variant, referring generally to FIGS. 1-6, a golf swing training aid 10 comprises a bottom piece 15. The bottom piece 15 comprises a slot 20 configured to receive a golf club 60. A vertical member 25 attaches from the bottom piece 15 to an upper member 30. A mechanism 35 attaches to the upper member 30. The mechanism 35 has sliders 40, 45 configured to slide up and down the mechanism 35 on rails 33. Each slider 40, 45 is attached to an arm cuff 50 configured to receive human arms 85. The upper member 30 has a connector 55 that attaches to a top end 80 of the golf club 60. The golf club 60 slides into the slot 20 of the bottom piece 15 of the golf training aid 10.

In a variant, referring to FIG. 1, the connector 55 is a needle 55 configured to penetrate into a channel in a top of a golf club 60.

Figure 2:
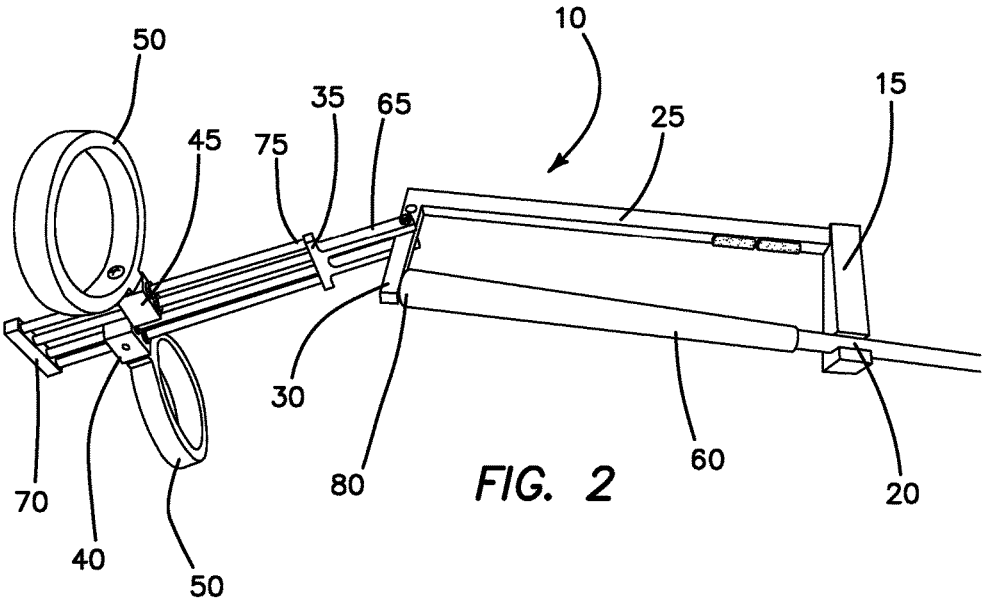
FIG. 2 is a side view of the golf training aid with a golf club inserted into the device.

In another variant, referring to FIG. 2, the upper member 30 is connected to the mechanism 35 via two support members 65 extending from the mechanism 35, one on each side of the upper member 30.

Figure 3:
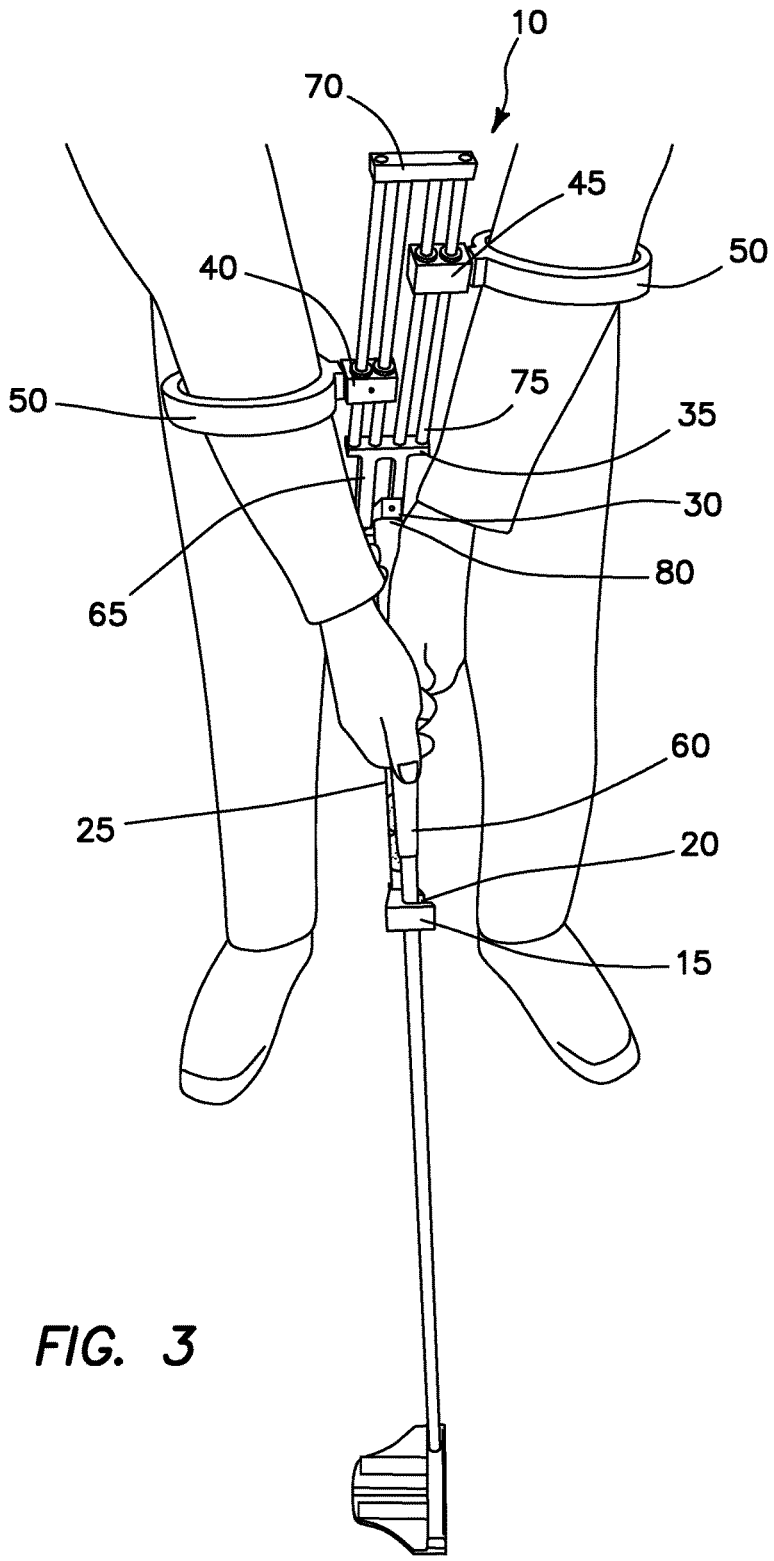
FIG. 3 is a front view of the golf training aid being used by a person.
Figure 4:
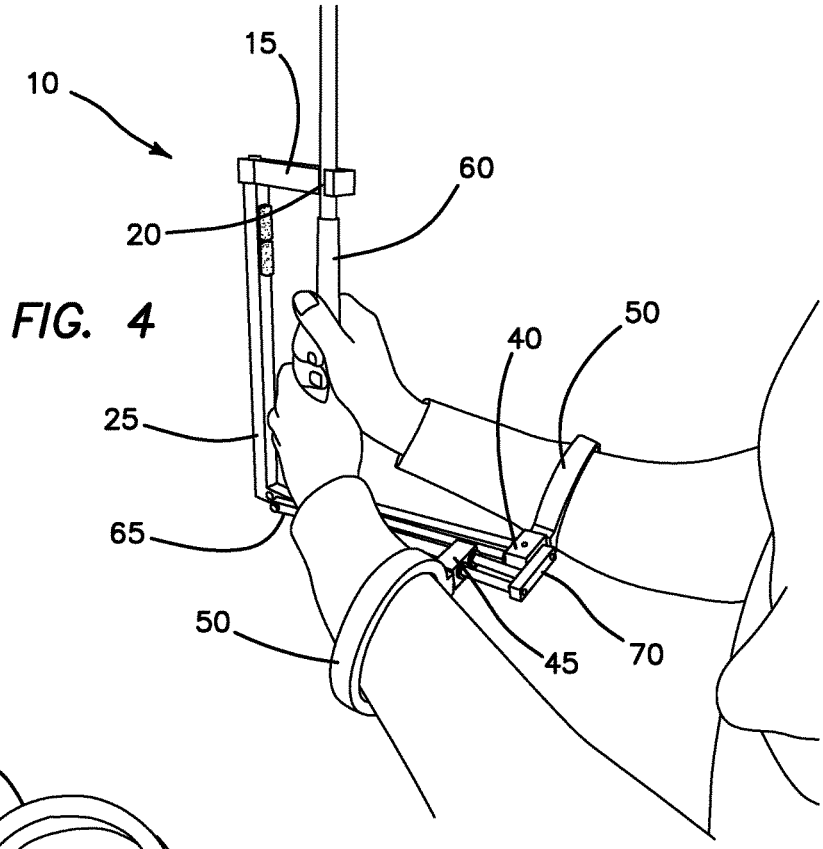
FIG. 4 is a side view of the golf training aid being used by a person.

In a further variant, referring to FIGS. 3-4, the arm cuffs 50 are rotatable about their diameter and slidable on the rails 33. In use, the cuffs will rotate and slide with each full swing of the golf club 60 when a golfer connects a golf club 60 to the golf training aid 10 and completes a full golf swing. The mechanism 70 has a first slider 40 and a second slider 45, which move independent of each other. The first slider 40 slides to the bottom of the mechanism 75 and the second slider 45 slides to the top of the mechanism 70 when swinging the golf club 60. Each arm cuff 50 moves with the respective slider 40, 45 it is attached to.

Figure 5:
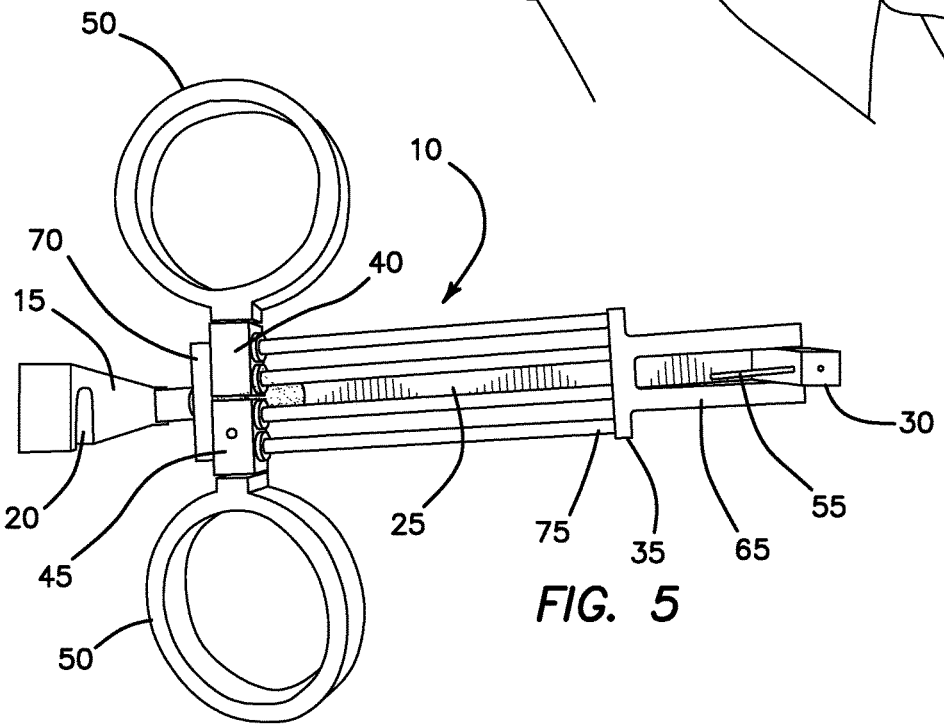
FIG. 5 is a top view of the golf training aid in a closed position.

In yet another variant, referring to FIG. 5, the support members 65 pivotally connect to the upper member 30 to allow the mechanism 35 to fold down and over the vertical member 25 into a closed position for easy transportation.

Figure 6:
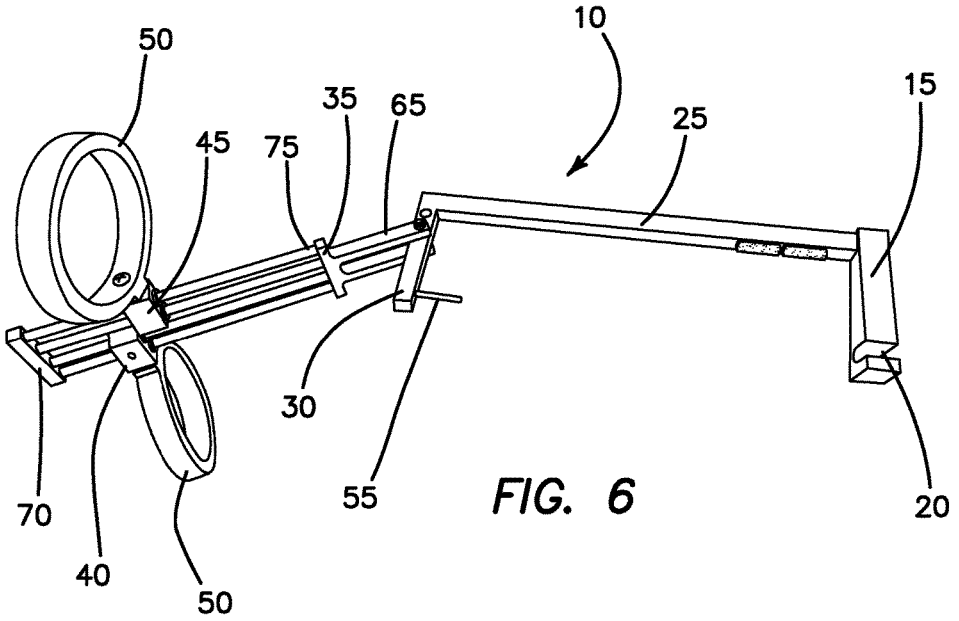
FIG. 6 is a side view of the golf training aid.

In another variant, referring to FIG. 6, the mechanism 75 comprises rails 33 that have the sliders 40, 45 attached thereto, wherein the sliders 40, 45 are slidable along the rails 33.

Figure 7:
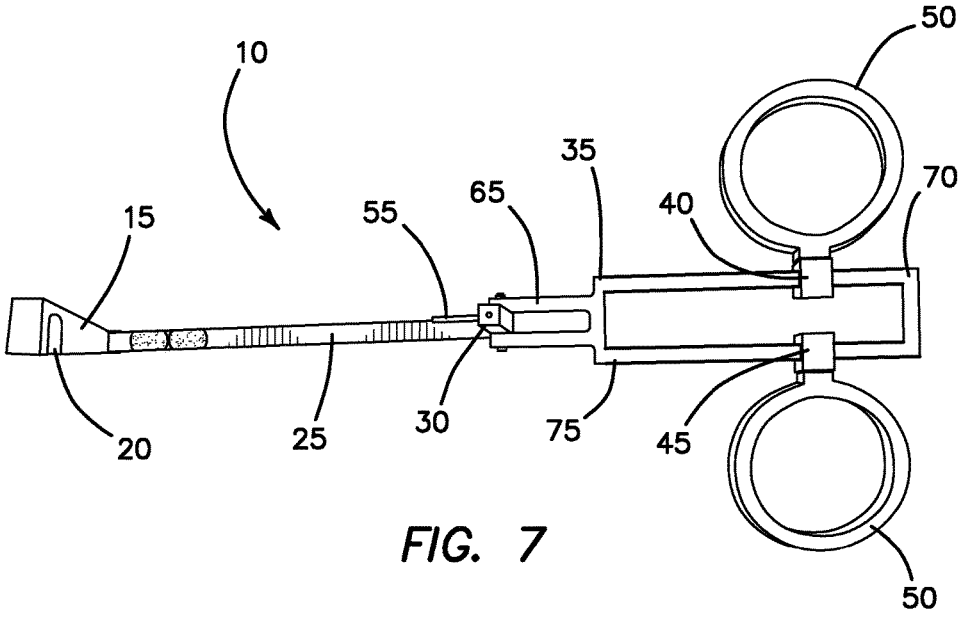
FIG. 7 is a top view of a variant of the golf training aid, without rails.

In a further variant, referring to FIG. 7, the cuffs 50 are optionally fixed in position so they cannot slide. This would be beneficial when practicing a putting motion. Rails 33 for sliding of the cuffs 50 are absent and not needed in this variant.

What is claimed is:

1. A golf training aid, comprising:

a bottom piece having a slot, configured to receive a golf club;

a vertical member that attaches from the bottom piece to an upper member;

a member having sliders configured to slide up and down a mechanism, wherein the mechanism attaches to the upper member;

arm cuffs attached to each slider, configured to receive human arms; and wherein the upper member has a connector that attaches to a top end of the golf club;

wherein the mechanism comprises rails that have the sliders attached thereto, wherein the sliders are slidable along the rails.

2. The golf training aid of claim 1, wherein the upper member is connected to the mechanism via two support members extending from the mechanism, one on each side of the upper member.

3. The golf training aid of claim 2, wherein the mechanism is configured to fold down and over the vertical member in a closed position.

4. The golf training aid of claim 1, wherein the arm cuffs are rotatable and slidable; wherein a golfer connects the golf club to the golf training aid and completes a full golf swing.

5. The golf training aid of claim 1, wherein the training aid has a first slider and a second slider which move independent of each other.

6. The golf training aid of claim 5, wherein the first slider is configured to slide to a bottom of the mechanism and the second slider is configured to slide to a top of the mechanism when a user swings a golf club attached to the training aid.

7. The golf training aid of claim 1, wherein the connector comprises a needle configured to penetrate into a channel in a top of a golf club.

8. The golf training aid of claim 1, wherein each arm cuff moves with the respective slider to which it is attached.

* * * * *